US011466607B2

(12) United States Patent
Sakata

(10) Patent No.: US 11,466,607 B2
(45) Date of Patent: Oct. 11, 2022

(54) RESERVOIR TANK

(71) Applicant: TIGERS POLYMER CORPORATION, Osaka (JP)

(72) Inventor: Shunsuke Sakata, Hyogo (JP)

(73) Assignee: TIGERS POLYMER CORPORATION, Osaka (JP)

( * ) Notice: Subject to any disclaimer, the term of this patent is extended or adjusted under 35 U.S.C. 154(b) by 0 days.

(21) Appl. No.: 17/464,259

(22) Filed: Sep. 1, 2021

(65) Prior Publication Data

US 2022/0099017 A1 Mar. 31, 2022

(30) Foreign Application Priority Data

Sep. 29, 2020 (JP) ..... JP2020-162929
Oct. 6, 2020 (JP) ..... JP2020-168813
Oct. 7, 2020 (JP) ..... JP2020-169517

(51) Int. Cl.
*F01P 11/02* (2006.01)
*F01P 11/04* (2006.01)

(52) U.S. Cl.
CPC ..... *F01P 11/02* (2013.01); *F01P 11/028* (2013.01); *F01P 11/029* (2013.01); *F01P 11/04* (2013.01)

(58) Field of Classification Search
CPC . F01P 11/02; F01P 11/04; F01P 11/028; F01P 11/029; F01P 11/0209; F01P 2011/0233
See application file for complete search history.

(56) References Cited

U.S. PATENT DOCUMENTS

2008/0190385 A1* 8/2008 Bangert ..... F01P 11/029 123/41.44

FOREIGN PATENT DOCUMENTS

JP 2005-248753 A 9/2005

* cited by examiner

*Primary Examiner* — Jacob M Amick
(74) *Attorney, Agent, or Firm* — Pearne & Gordon LLP

(57) ABSTRACT

Provided is a reservoir tank which includes: a tank body that stores cooling fluid; an inflow pipe configured to feed the cooling fluid into the tank body; a discharge pipe configured to discharge the cooling fluid from the tank body; a columnar member erected inside the tank body; and a guide member provided inside the tank body, in which the inflow pipe is connected to the tank body at a position vertically below a liquid level of the cooling fluid stored inside the tank body, the guide member is configured to guide a flow of the cooling fluid flowing from the inflow pipe into the tank body, the flow being guided into a substantially horizontal direction toward the columnar member, the columnar member extends in a substantially vertical direction when viewed along the flow of the cooling fluid toward the columnar member, and a part of the columnar member is disposed on an extension line of the flow of the cooling fluid toward the columnar member.

6 Claims, 7 Drawing Sheets

RESERVOIR TANK

CROSS-REFERENCE TO RELATED APPLICATION

This application claims priority from Japanese Patent Application No. 2020-162929 filed with the Japan Patent Office on Sep. 29, 2020, from Japanese Patent Application No. 2020-168813 filed with the Japan Patent Office on Oct. 6, 2020, and from Japanese Patent Application No. 2020-169517 filed with the Japan Patent Office on Oct. 7, 2020, the entire contents of which are hereby incorporated by reference.

BACKGROUND

1. Technical Field

One aspect of the present disclosure relates to a reservoir tank.

2. Related Art

Liquid-cooled cooling systems are used for cooling internal combustion engines, electric elements, electronic boards, and the like. In the liquid-cooled cooling system, heat is collected from a member to be cooled by circulating a cooling fluid, which dissipates the heat through a heat radiator, in order to cool the member to be cooled. In the liquid-cooled cooling system, a cooling fluid tank, that is, the reservoir tank, may be provided in a cooling fluid circuit for circulating the cooling fluid. The reservoir tank is used to compensate for a decrease in the cooling fluid due to vaporization or the like, and to absorb a volume change of the cooling fluid due to a temperature change. When air bubbles are generated in the cooling fluid, cooling efficiency may decrease. Therefore, the bubbles in the cooling fluid may be separated by the reservoir tank, that is, gas-liquid separation may be performed.

For example, in a technique disclosed in JP-A-2005-248753, rectangular baffle plates are arranged in a reservoir tank body so as to have a windmill shape in a specific direction. JP-A-2005-248753 discloses that according to the reservoir tank, the bubbles can be separated from the cooling fluid without increasing water flow resistance and complicating its structure.

SUMMARY

A reservoir tank according to an embodiment of the present disclosure includes: a tank body that stores cooling fluid; an inflow pipe configured to feed the cooling fluid into the tank body; a discharge pipe configured to discharge the cooling fluid from the tank body; a columnar member erected inside the tank body; and a guide member provided inside the tank body, in which the inflow pipe is connected to the tank body at a position vertically below a liquid level of the cooling fluid stored inside the tank body, the guide member is configured to guide a flow of the cooling fluid flowing from the inflow pipe into the tank body, the flow being guided into a substantially horizontal direction toward the columnar member, the columnar member extends in a substantially vertical direction when viewed along the flow of the cooling fluid toward the columnar member, and a part of the columnar member is disposed on an extension line of the flow of the cooling fluid toward the columnar member.

DETAILED DESCRIPTION

Figure 1:
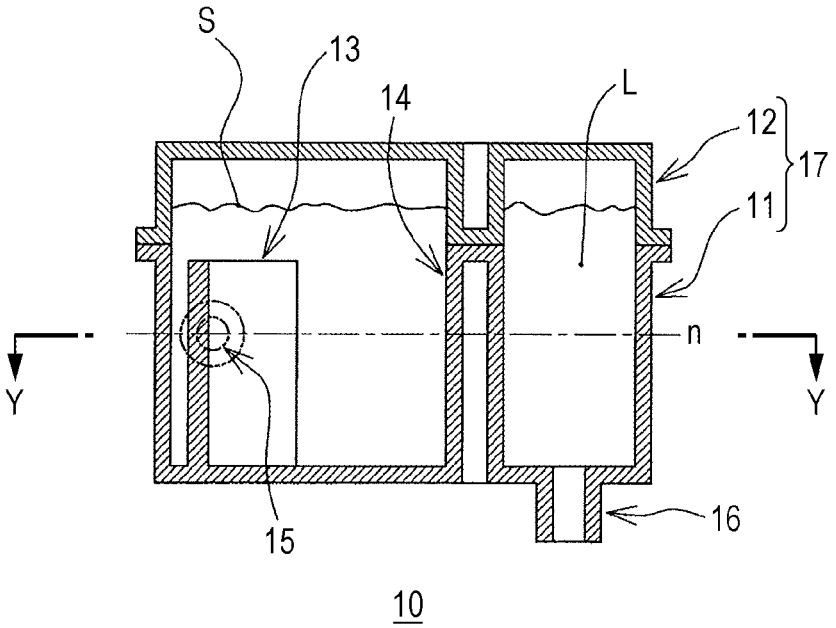
FIG. 1 is a vertical cross-sectional view illustrating a structure of a reservoir tank of a first embodiment.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

In recent years, in order to improve performance of a cooling system, there has been a demand for increasing a flow rate of cooling fluid passing through a reservoir tank as disclosed in JP-A-2005-248753. However, it has been found that when the flow rate of the cooling fluid passing through the reservoir tank increases in the reservoir tank as disclosed in JP-A-2005-248753, the cooling fluid flowing into a tank body tends to be undulating and turbulent, and thus air in the tank is easily entrained in the cooling fluid and thereby generate air bubbles, so that it is difficult to obtain an expected level of gas-liquid separation effect.

Specifically, in recent years, as the demand for miniaturization of the reservoir tank has increased, turbulence of the cooling fluid inside the tank body is likely to occur. Further, for example, due to restrictions on a space in which the reservoir tank is disposed, an inflow pipe and a discharge pipe of the reservoir tank may not be arranged at a position in which a flow of the cooling fluid inside the tank can be optimized. An object of the present disclosure is to suppress turbulence of a liquid surface inside the tank body of the reservoir tank and to suppress generation of air bubbles inside the reservoir tank. Another object of the present disclosure is to improve the flow of the cooling fluid in the tank and to increase a degree of freedom in arranging the inflow pipe of the reservoir tank.

According to findings obtained as a result of diligent studies by the inventors, when the cooling fluid flows directly into the cooling fluid stored in the tank body from the inflow pipe, the flow of the cooling fluid from the inflow pipe can be guided into a substantially horizontal direction toward a columnar member by a guide member provided in the tank body. At this time, if a part of the columnar member is disposed on an extension line of the flow of the cooling fluid, the turbulence of the liquid surface inside the tank body is suppressed, and the degree of freedom in arranging the inflow pipe of the tank is increased. Based on the findings, the reservoir tank of the present disclosure has been completed.

A reservoir tank according to an embodiment of the present disclosure includes: a tank body that stores cooling fluid; an inflow pipe configured to feed the cooling fluid into the tank body; a discharge pipe configured to discharge the cooling fluid from the tank body; a columnar member erected inside the tank body; and a guide member provided inside the tank body, in which the inflow pipe is connected to the tank body at a position vertically below a liquid level of the cooling fluid stored inside the tank body, the guide member is configured to guide a flow of the cooling fluid flowing from the inflow pipe into the tank body, the flow being guided into a substantially horizontal direction toward the columnar member, the columnar member extends in a substantially vertical direction when viewed along the flow of the cooling fluid toward the columnar member, and a part of the columnar member is disposed on an extension line of the flow of the cooling fluid toward the columnar member (first aspect).

In the first aspect, it is preferred that a plurality of the columnar members includes a first columnar member and a second columnar member, the plurality of columnar members is arranged so that a flow of the cooling fluid flowing from the guide member into the columnar member is divided in a substantially horizontal direction by the first columnar member, and the divided flow of the cooling fluid is further divided in the substantially horizontal direction by the second columnar member (second aspect). Further, in the first aspect, it is preferred that a position in which the extension line of the flow of the cooling fluid toward the columnar member and the columnar member intersect is vertically below the liquid level of the cooling fluid (third aspect). It is also preferred that the guide member has a curved guide surface, and a central axis of the inflow pipe forms an angle of 30 degrees or more and 90 degrees or less with respect to a horizontal plane (fourth aspect).

Further, in any one of the first to fourth aspects, the columnar member is preferably disposed to connect a top surface and a bottom surface of the tank body (fifth aspect). Further, in any one of the first to fourth aspects, a cross-sectional shape of the columnar member in a horizontal plane is preferably convex toward an upstream side of a flow of the cooling fluid (sixth aspect). Furthermore, in any one of the first to fourth aspects, a width of the columnar member when viewed along the flow of the cooling fluid toward the columnar member is preferably 0.5 times or more and 3 times or less a diameter of the inflow pipe (seventh aspect).

Further, a reservoir tank according to another embodiment of the present disclosure includes: a tank body that stores cooling fluid; an inflow pipe configured to feed the cooling fluid into the tank body; a discharge pipe configured to discharge the cooling fluid from the tank body; a columnar member erected inside the tank body; and a guide member provided inside the tank body, in which a pipe line is formed by the guide member and a wall surface of the tank body, the pipe line is connected to the inflow pipe at one end thereof, and is opened to an inner space of the tank body at a position vertically below a liquid level of the cooling fluid stored inside the tank body at the other end thereof, the pipe line is configured to guide a flow of the cooling fluid flowing from the inflow pipe through the pipe line into the tank body, the flow being guided into a substantially horizontal direction toward the columnar member, the columnar member extends in a substantially vertical direction when viewed along the flow of the cooling fluid toward the columnar member, and a part of the columnar member is disposed on an extension line of the flow of the cooling fluid toward the columnar member (eighth aspect).

According to the first and eighth aspects of the present disclosure, since the turbulence of the liquid surface inside the tank body is suppressed, the generation of the bubbles inside the reservoir tank can be suppressed. Further, since the guide member is provided, the degree of freedom in the position and angle in which the inflow pipe is provided is increased. Furthermore, according to the eighth aspect, the degree of freedom in the position and angle in which the inflow pipe is provided is particularly increased.

According to the second to fourth aspects, an effect of suppressing the turbulence of the liquid surface and an effect of suppressing the generation of the bubbles are further improved. Further, according to the fourth aspect, the degree of freedom in the position and angle in which the inflow pipe is provided is particularly increased. Further, according to the fifth aspect, vibration of the columnar member is suppressed. As a result, generation of noise from the reservoir tank is suppressed. Further, according to the sixth aspect and the seventh aspect, the effect of suppressing the turbulence of the liquid surface and the effect of suppressing the generation of the bubbles are further improved.

Hereinafter, embodiments of the present disclosure will be described with reference to the drawings, taking the reservoir tank provided in a liquid-cooled cooling system for an internal combustion engine of an automobile as an example. The technology of the present disclosure is not limited to individual embodiments described below, but may also be implemented as modified embodiments below. Applications of the liquid-cooled cooling system are not limited to the internal combustion engine, but may be applications for cooling an electric element such as a power element and an inverter, an electric component such as an electronic circuit board, and others.

Figure 2:
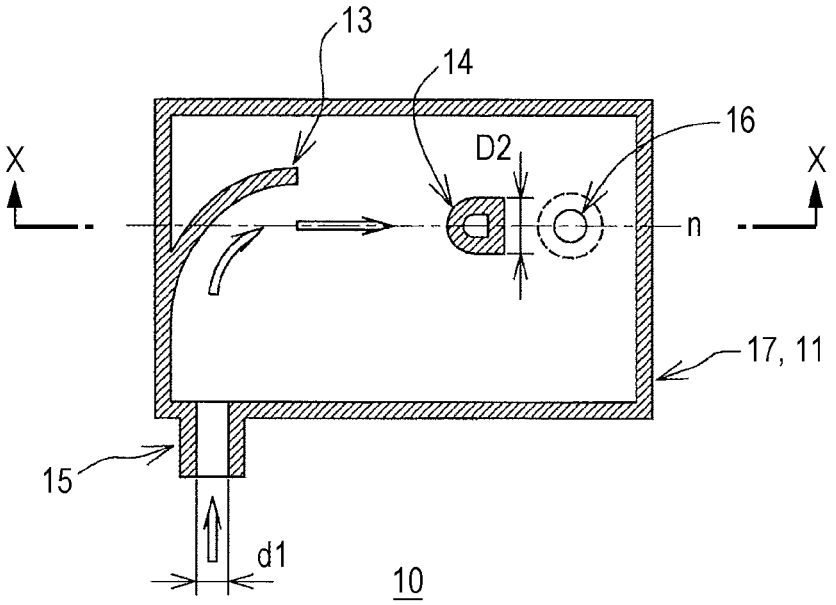
FIG. 2 is a horizontal cross-sectional view illustrating the structure of the reservoir tank of the first embodiment.

FIGS. 1 and 2 illustrate a structure of a reservoir tank 10 of a first embodiment. FIG. 1 illustrates a vertical cross-sectional view of the reservoir tank 10. FIG. 2 illustrates a horizontal cross-sectional view of the reservoir tank 10. The vertical cross-sectional view of FIG. 1 is an X-X cross-sectional view taken along a vertical plane through a line X-X of FIG. 2. Further, the horizontal cross-sectional view of FIG. 2 is a Y-Y cross-sectional view taken along a horizontal plane through a line Y-Y of FIG. 1. The reservoir tank 10 is configured to include a hollow tank 17, and an inflow pipe 15 and a discharge pipe 16 connected to the tank. The reservoir tank 10 used in a cooling fluid circuit of the liquid-cooled cooling system is disposed and connected in the cooling fluid circuit of the liquid-cooled cooling system so that the cooling fluid flows from the inflow pipe 15 into the hollow tank 17, and the cooling fluid flows out of the hollow tank 17 through the discharge pipe 16.

In the vertical cross-sectional view of FIG. 1, an upper side of the figure shows a vertically upper side. In the present embodiment, a lower case 11 and an upper case 12 are integrated to form the reservoir tank 10. The lower case 11 and the upper case 12 are integrated to form a hollow tank body 17. In the present embodiment, an inflow pipe 15 and a discharge pipe 16 are integrally molded in the lower case 11. In this regard, the inflow pipe 15 and the discharge pipe 16 may be integrated with the tank body 17 by a manufacturing method different from an integral molding.

A cooling fluid L is stored in the tank body 17. Air is stored in a vertically upper portion of the tank body 17. The inflow pipe 15 is connected to the tank body 17 vertically below a liquid level (liquid surface) S of the cooling fluid stored inside the tank body 17. With such a configuration, the cooling fluid sent from the inflow pipe 15 flows directly into the cooling fluid stored in the tank (that is, without passing through the air).

The discharge pipe 16 is also connected to the tank body 17 vertically below the liquid level S of the cooling fluid stored inside the tank body 17. With such a configuration, the cooling fluid is efficiently discharged from the tank body 17 through the discharge pipe 16.

A columnar member 14 is erected inside the tank body 17. In the present embodiment, one columnar member 14 extending in a substantially vertical direction is erected. A plurality of the columnar members may be erected as in a modification described below. Further, the columnar member may be inclined with respect to the vertical direction.

A guide member 13 is provided inside the tank body 17. In the present embodiment, a plate-like guide member 13 having a curved guide surface is provided. Typically, the guide member is provided to be entirely submerged in the cooling fluid. The guide member 13 guides the flow of the cooling fluid flowing from the inflow pipe 15 into the tank body, the flow being guided into the substantially horizontal direction toward the columnar member 14. That is, a jet of the cooling fluid flowing therein from the inflow pipe 15 flows along the guide surface of the guide member 13. At this time, a direction of the jet changes. Therefore, the cooling fluid flows substantially horizontally toward the columnar member 14.

The columnar member 14 extends in the substantially vertical direction when viewed along a flow of the cooling fluid flowing from the guide member 13 toward the columnar member 14. The columnar member 14 does not have to extend exactly in the vertical direction. It can be said that the columnar member 14 extends in the substantially vertical direction if it is inclined in a range of about 30 degrees or less from the vertical direction.

Figure 3:
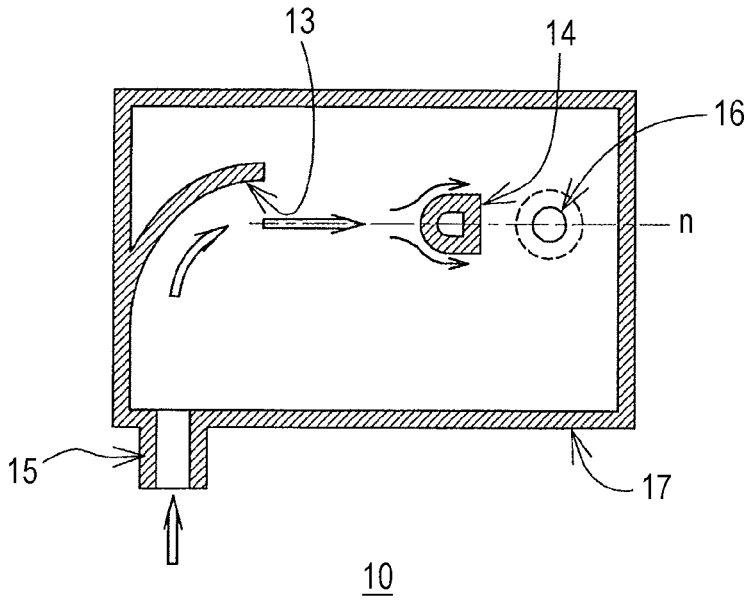
FIG. 3 is a horizontal cross-sectional view illustrating an operation of the reservoir tank of the first embodiment.

Further, a part of the columnar member 14 is disposed on an extension line n of the flow of the cooling fluid toward the columnar member 14. With this configuration, the jet of the cooling fluid guided by the guide member 13 toward the columnar member in the substantially horizontal direction flows to hit a part of the columnar member 14, and the jet is divided to flow in the substantially horizontal direction so as to avoid the columnar member 14 (FIG. 3).

Although not essential, in the present embodiment, the columnar member 14 has a hollow shape having a substantially D-shaped cross-section (cross-section in the horizontal plane). Then, the columnar member 14 is provided so that a cylindrically curved surface of the columnar member 14 faces the guide member 13. As will be described below, the columnar member 14 may have another shape.

Although not essential, as in the present embodiment, a position in which the extension line n of the flow of the cooling fluid toward the columnar member 14 and the columnar member 14 intersect is preferably vertically below the liquid level S of the cooling fluid. The position in which the extension line n of the flow of the cooling fluid toward the columnar member 14 and the columnar member 14 intersect may be substantially the same height in the vertical direction as the liquid level S of the cooling fluid. The position in which the extension line n of the flow of the cooling fluid toward the columnar member 14 and the columnar member 14 intersect is more preferably vertically below a position in which the inflow pipe 15 is connected to the tank body 17.

Further, although not essential, as in the present embodiment, it is preferred that the cooling fluid flowing toward the columnar member 14 flows substantially horizontally, and the columnar member 14 extends in the substantially vertical direction.

Further, although not essential, it is preferred that the columnar member 14 is disposed to connect the top wall and the bottom wall of the tank body 17 as in the present embodiment. As in the present embodiment, it is particularly preferred that the columnar member 14 is divided into a component on the lower case side and a component on the upper case side, and the divided components of the columnar member 14 are joined (preferably welded) to each other.

Further, although not essential, it is preferred that the cross-sectional shape of the columnar member 14 in the horizontal plane is convex toward the upstream side of the flow of the cooling fluid as in the present embodiment.

Further, although not essential, it is preferred that, as in the present embodiment, a width D2 of the columnar member 14 when viewed along the flow of the cooling fluid toward the columnar member 14 is 0.5 times or more and 3 times or less a diameter (an inner diameter) d1 of the inflow pipe 15, that is, $0.5*d1 \leq D2 \leq 3*d1$ is satisfied. It is particularly preferred that $1*d1 \leq D2 \leq 1.5*d1$ is satisfied. In the present embodiment, $D2=1.3*d1$ is satisfied. If $0.5*d1 \leq D2$, a flow dividing effect by the columnar member is likely to be sufficiently obtained. Further, if $D2 \leq 3*d1$, it is more likely to prevent the flow of the cooling fluid from hitting the columnar member 14 hard and from heading vertically upward. As a result, the turbulence of the liquid surface of the cooling fluid can be suppressed more effectively.

As long as the reservoir tank 10 can be configured by the tank body 17, the guide member 13, the columnar member 14, the inflow pipe 15, and the discharge pipe 16, how is the above-mentioned structure of the reservoir tank 10 specifically divided into specific parts and how to assemble the reservoir tank 10 from those parts (what constituent members (components) are used to assemble the reservoir tank 10) are not particularly limited. In the present embodiment, the above-described structure of the reservoir tank 10 is realized by dividing the reservoir tank 10 into two parts of the lower case 11 and the upper case 12, and assembling them. In this regard, the above-mentioned structure of the reservoir tank 10 may be realized by other constituent members. For example, the above-mentioned structure of the reservoir tank 10 may be realized by forming constituent members such that the tank body 17 is divided into two in the vertical plane, and assembling them.

Further, in the first embodiment, a material forming the reservoir tank 10 and a method for manufacturing the reservoir tank 10 are not particularly limited. The reservoir tank 10 can be manufactured by a known material and a known manufacturing method. Typically, the reservoir tank 10 is formed using a thermoplastic resin such as a polyamide resin as a main material. The material, reinforcing structure, and the like of the reservoir tank 10 are determined depending on the type, temperature, pressure, and the like of the cooling fluid to be used. Typically, the reservoir tank 10 can be manufactured by respectively forming members corresponding to the lower case 11 and the upper case 12 by injection molding, and by integrating the members by vibration welding, hot plate welding or the like. In this case, it is preferred that the inflow pipe 15, the discharge pipe 16, the guide member 13, and the columnar member 14 are integrally molded with the lower case 11 or the upper case 12. Alternatively, the inflow pipe 15, the discharge pipe 16, the guide member 13 and the columnar member 14 may be formed as members separate from the lower case 11 or the upper case 12, and may be integrated with the lower case 11 or the upper case 12 by later assembly.

The operation and effect of the reservoir tank 10 of the first embodiment will be described. According to the reservoir tank 10 of the first embodiment, it is possible to suppress the turbulence of the liquid surface inside the tank body 17, and to suppress the generation of the bubbles.

Figure 9:
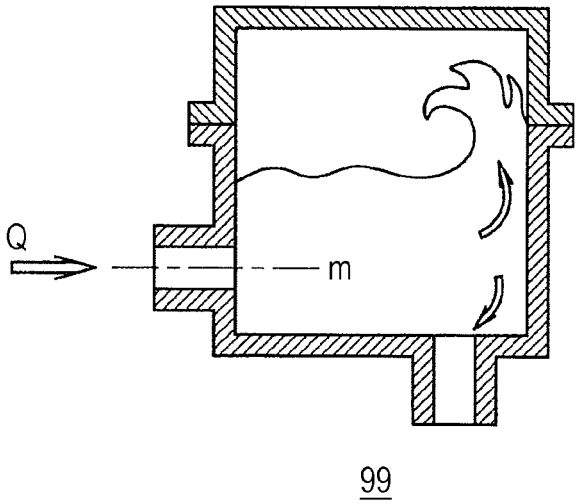
FIG. 9 is a vertical cross-sectional view illustrating the operation of the reservoir tank of a reference example.

FIG. 9 illustrates the flow of the cooling fluid inside the tank body in the reservoir tank without the columnar member as a reference example. A configuration of the reference example of FIG. 9 is the same as that of the reservoir tank 10 of the first embodiment except that the guide member and the columnar member 14 are not provided, and that the arrangement of the inflow pipe differs.

In a reservoir tank 99 of the reference example, when the cooling fluid vigorously flows therein from the inflow pipe, the cooling fluid flowing into the tank body (a flow Q of the cooling fluid flowing therein is indicated by a white arrow) directly goes straight, and violently hits a tank wall facing the inflow pipe. Thus, the cooling fluid is dispersed upward and flows. Due to this upward flow, the liquid surface of the cooling fluid inside the tank body violently undulates. This violent undulation causes air to get caught in the cooling fluid. As a result, the bubbles are generated.

In particular, when the cooling fluid flows into the tank vertically upward from the inflow pipe, for example, due to restrictions on the surrounding layout, the liquid surface of the cooling fluid inside the tank body undulates particularly violently. As a result, the bubbles are generated. Therefore, in the reservoir tank as in the reference example, there are many restrictions on arrangement of the inflow pipe.

The bubbles in the cooling fluid reduce circulation efficiency of the cooling fluid or heat transport efficiency of the cooling fluid. As a result, cooling performance of the cooling system is reduced.

In the reservoir tank 10 of the first embodiment, the inflow pipe 15 is connected to the tank body at a position vertically below the liquid level S of the cooling fluid. Further, the guide member and the columnar member are erected inside the tank body. Therefore, the guide member 13 provided inside the tank body guides the flow of the cooling fluid flowing from the inflow pipe into the tank body, the flow being guided into the substantially horizontal direction toward the columnar member 14. Further, the columnar member 14 extends in the substantially vertical direction when viewed along the flow of the cooling fluid toward the columnar member 14. Further, a part of the columnar member 14 is disposed on the extension line n of the flow of the cooling fluid toward the columnar member. Therefore, since the turbulence of the liquid surface inside the tank body is suppressed, the generation of the bubbles inside the reservoir tank can be suppressed.

Figure 4:
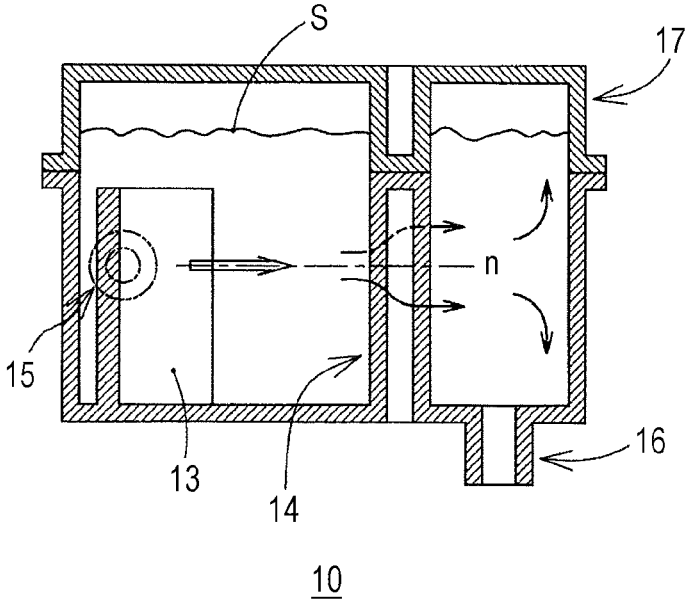
FIG. 4 is a vertical cross-sectional view illustrating the operation of the reservoir tank of the first embodiment.

That is, in the reservoir tank 10 of the first embodiment, the cooling fluid flowing therein from the inflow pipe does not pass through the air, but directly flows into the cooling fluid stored therein. At the same time, the cooling fluid flowing from the inflow pipe 15 is guided by the guide member 13 and flows substantially horizontally toward the columnar member 14. Then, the cooling fluid flows to hit the columnar member 14, and is divided and flows in the substantially horizontal direction so as to avoid the columnar member 14 as illustrated in FIG. 3. Due to this division, a vigorous flow of the cooling fluid flowing therein from the inflow pipe 15 is dispersed by the columnar member 14 and weakened. As a result, the weakened flow of the cooling fluid L hits the wall surface of the tank body 17. Therefore, the violent undulation of the liquid surface S as in the reference example of FIG. 9 is suppressed. Therefore, in the reservoir tank 10 of the first embodiment, the turbulence of the liquid surface inside the tank body 17 is suppressed. As a result, the generation of the bubbles inside the reservoir tank 10 can be suppressed (FIG. 4).

Further, the arrangement of the inflow pipe is usually restricted by the surrounding layout. Therefore, it may be difficult to provide the columnar member so that the jet flow flowing from the inflow pipe is suitably divided. In the reservoir tank 10 of the first embodiment, the guide member 13 allows the jet of the cooling fluid flowing therein from the inflow pipe to flow in the substantially horizontal direction so as to flow toward the columnar member. Therefore, by adjusting a position, shape, and angle of the guide member, it is possible to better control the flow of the cooling fluid inside the tank and to suppress the generation of the bubbles even if restrictions on layout of the inflow pipe are accepted. Therefore, the degree of freedom in the layout of the inflow pipe is increased.

A specific form of the guide member 13 is not particularly limited as long as it has the guide surface that can guide the flow of the cooling fluid from the inflow pipe 15 into the substantially horizontal direction toward the columnar member 14. The guide member may have a plate shape, particularly a rib shape projecting from the tank body. Further, the guide member may be in the shape of a block. Alternatively, as in a second embodiment described below, it may be a part of a peripheral wall of the tank body 17 deformed.

Further, in the guide member 13, a shape of the guide surface for guiding the cooling fluid may be planar. The shape is preferably the curved guide surface. A preferred example is a curved plate-like guide member. Further, the guide member may be provided in a gutter shape or a tubular shape so that the jet of the cooling fluid does not disperse upward in the vertical direction. An example in which a tubular guide member is provided will be described below as a fourth embodiment.

Figure 5:
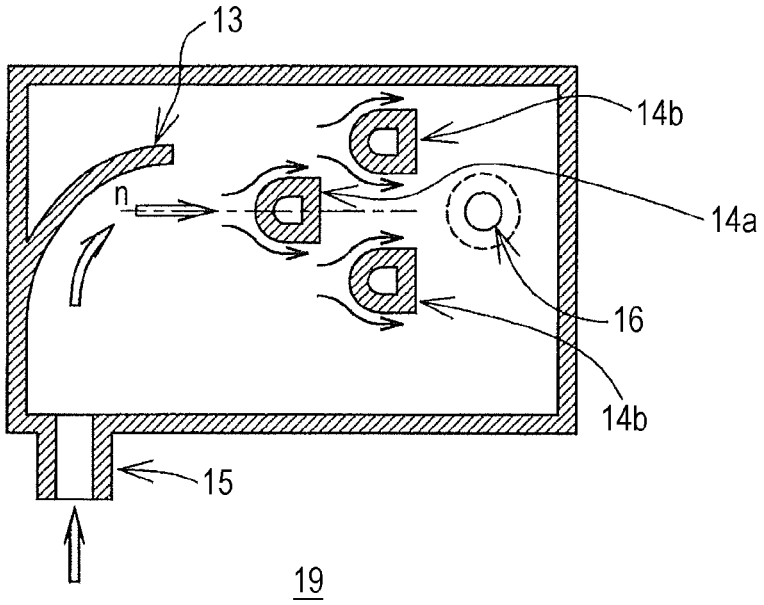
FIG. 5 is a horizontal cross-sectional view illustrating the structure and the operation of the reservoir tank of a first modification.

Further, from the viewpoint of better suppressing the generation of the bubbles inside the reservoir tank by better suppressing the turbulence of the liquid surface inside the tank body 17, a configuration such as a reservoir tank 19 of a first modification illustrated in FIG. 5 may be used. The reservoir tank 19 has a plurality of columnar members 14*a*, 14*b*, and 14*b*. It is preferred that the columnar members 14*a*, 14*b*, and 14*b* are arranged such that the flow of the cooling fluid flowing from the inflow pipe 15 into the tank body 17 is bent to flow toward the columnar member 14 by the guide member 13 and divided into two by the first columnar member 14*a* in the substantially horizontal direction, and the divided flow of the cooling fluid is further divided into two in the substantially horizontal direction by the second columnar member 14*b*. Two, three, four or more columnar members may be provided. Further, the division of the flow by the columnar member may be the division into two flows, or may be the division into three or more flows.

According to the configuration such as the reservoir tank 19 of the first modification, the flow of the cooling fluid is further dispersed and divided, to be a gentle flow. Therefore, the effect of suppressing the turbulence of the liquid surface inside the tank body 17 and the effect of suppressing the generation of the bubbles inside the reservoir tank 19 can be further improved. Further, when the plurality of columnar members is provided, it is preferred that the columnar members are arranged as in an arrangement of bowling pins with respect to the direction of the flow of the cooling fluid from the guide member 13 toward the columnar member 14.

Further, from the viewpoint of better suppressing the generation of the bubbles inside the reservoir tank by better suppressing the turbulence of the liquid surface inside the tank body 17, it is preferred that the position in which the extension line n of the flow of the cooling fluid toward the columnar member and the columnar member 14 intersect is vertically below the liquid level S of the cooling fluid. In this case, the flow of the cooling fluid toward the columnar member is suppressed from vigorously blowing out upward beyond the liquid level of the cooling fluid. Therefore, the turbulence of the liquid surface inside the tank body is better suppressed.

Further, from the viewpoint of further suppressing the turbulence of the liquid surface inside the tank body and suppressing the generation of the bubbles inside the reservoir tank, it is preferred that the cooling fluid flowing toward the columnar member flows substantially horizontally and the columnar member 14 extends in the substantially vertical direction. With such a configuration, the flow of the cooling fluid toward the columnar member is surely divided in the substantially horizontal direction by the columnar member 14. Therefore, the cooling fluid is less likely to flow in the vertical direction, so that the turbulence of the liquid surface inside the tank body is further suppressed.

Further, when the columnar member 14 is disposed to connect the top wall and the bottom wall of the tank body 17 as in the reservoir tank 10 of the first embodiment, an effect of suppressing the generation of noise from the reservoir tank 10 is also obtained, since the vibration of the columnar member 14 is suppressed. The cooling fluid hits the columnar member 14 as the jet. Therefore, if the columnar member 14 is erected like a cantilever, the columnar member 14 tends to vibrate, and the noise may be generated from the reservoir tank 10. When the columnar member 14 is disposed like a double-supported beam so as to connect the top wall and the bottom wall of the tank body 17, rigidity of a portion of the columnar member 14 where the flow of the cooling fluid hits is increased. As a result, since the vibration of the columnar member 14 is suppressed, the generation of noise from the reservoir tank 10 is suppressed.

The aspects of the present disclosure are not limited to the above embodiments, but can be implemented with various modifications. Hereinafter, other embodiments of the present disclosure will be described. In the following description, portions different from the above embodiment will be mainly described, and the same portions will be denoted by the same reference numerals and detailed description thereof will be omitted. Further, the embodiments can be implemented by combining some of them or replacing some of them.

Figure 6:
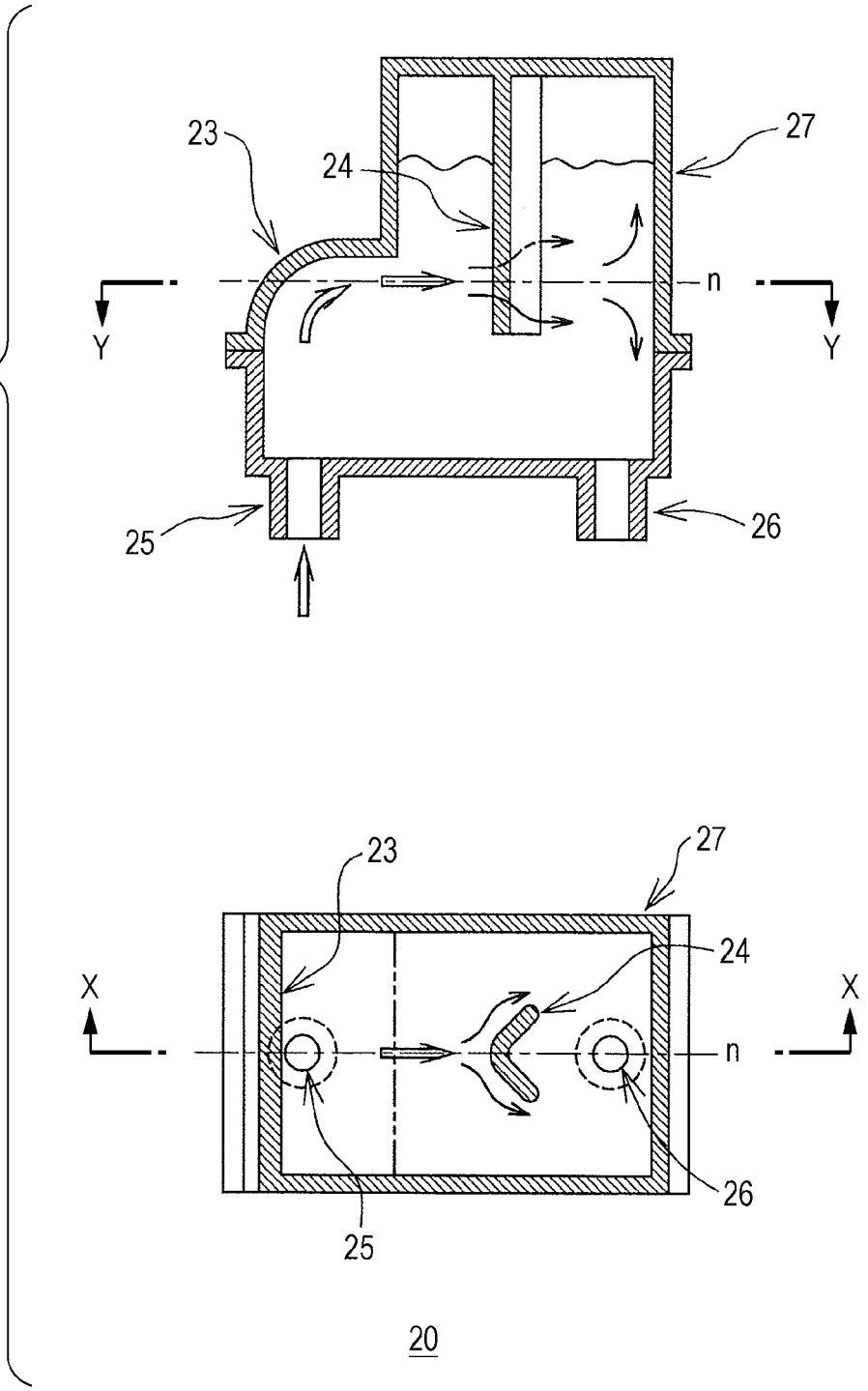
FIG. 6 is a vertical cross-sectional view and a horizontal cross-sectional view illustrating the structures of the reservoir tank of a second embodiment.

FIG. 6 illustrates a reservoir tank 20 of the second embodiment. FIG. 6 is a vertical cross-sectional view (upper drawing) of the reservoir tank 20 corresponding to FIG. 1 in the first embodiment and a horizontal cross-sectional view (lower drawing) of the reservoir tank 20 corresponding to FIG. 2 in the first embodiment. In the reservoir tank 20 of the second embodiment, a position and direction of an inflow pipe 25, a shape of a guide member 23, and a shape of a columnar member 24 are different from those of the reservoir tank 10 of the first embodiment. Other configurations are substantially the same as those of the reservoir tank 10 of the first embodiment.

In the reservoir tank 20 of the second embodiment, the inflow pipe 25 is provided on a bottom surface of a tank body 27 so as to extend in a substantially vertical direction. Note that also in the present embodiment, as in the first embodiment, a discharge pipe 26 is provided vertically downward from the bottom surface of the tank. However, a position and direction of the discharge pipe can be changed.

Further, in the reservoir tank 20 of the second embodiment, a part of the peripheral wall of the tank body 27 forms the guide member. That is, the peripheral wall of the tank body 27 is formed in a shape curved like a cylindrical surface so that the cooling fluid flowing vertically upward from the inflow pipe 25 turns about 90 degrees and flows substantially horizontally toward the columnar member 24. This curved portion functions as the guide member 23. That is, the guide member 23 has a curved guide surface.

Figure 7A:
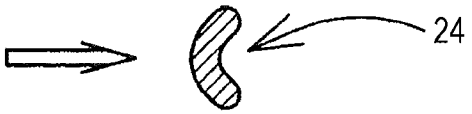
FIGS. 7A to 7F are horizontal cross-sectional views illustrating a shape of a modification of a columnar member.

Further, in the reservoir tank 20 of the second embodiment, the columnar member 24 is a columnar member 24 having a chevron cross-section as illustrated in FIG. 7A. Further, in the reservoir tank of the second embodiment, the columnar member 24 is provided in a cantilever shape so as to project from the top surface of the tank body toward the bottom surface of the tank.

Even in the reservoir tank 20 of the second embodiment, similarly to the reservoir tank 10 of the first embodiment, the flow of the cooling fluid can be divided and dispersed in the substantially horizontal direction by the guide member 23 and the columnar member 24. Therefore, it is possible to suppress the turbulence of the liquid surface inside the tank body and suppress the generation of the bubbles inside the reservoir tank.

Further, as in the reservoir tank 20 of the second embodiment, the central axis of the inflow pipe 25 may form an angle of 30 degrees or more and 90 degrees or less with respect to the horizontal plane. Also in this case, the guide member 23 can guide the cooling fluid so as to flow in the substantially horizontal direction and toward the columnar member 24. Therefore, the generation of the bubbles inside the reservoir tank can be suppressed. As described above, even when the central axis of the inflow pipe 25 forms the angle of 30 degrees or more and 90 degrees or less with respect to the horizontal plane, the generation of the bubbles can be suppressed. Therefore, the degree of freedom in arranging the inflow pipe and the like is particularly increased.

Figure 7B:
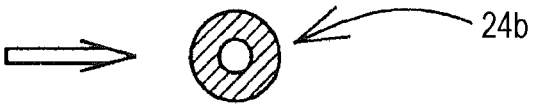

FIGS. 7B to 7F illustrate examples of cross-sectional shapes in the horizontal plane of the columnar members according to other embodiments. In FIGS. 7A to 7F, white arrows indicate the directions of the flows of the cooling fluids toward the columnar members. The columnar member may be a columnar member 24 having a chevron cross-section (V-shaped cross-section) as illustrated in FIG. 7A. Further, the columnar member may be a columnar member 24*b* having a circular cross-section (hollow cylindrical cross-section) as illustrated in FIG. 7B. Further, the columnar member may be a solid member, for example, a columnar member having a solid columnar cross-section. Furthermore, the columnar member may be a prismatic member, an elliptical columnar member, a conical member, or a pyramidal member.

Figure 7C:
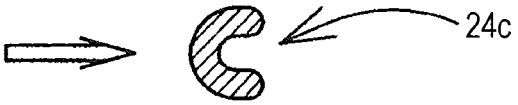
Figure 7D:
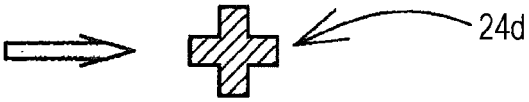
Figure 7E:
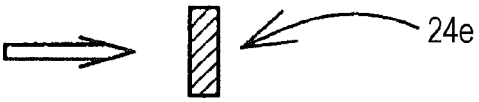
Figure 7F:
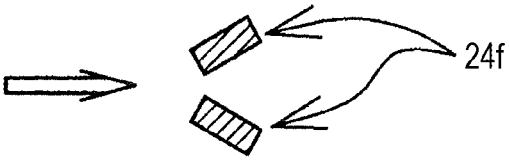

Further, the columnar member may be a columnar member 24*c* having a C-shaped (or U-shaped) cross-section as illustrated in FIG. 7C. Further, the columnar member may be a columnar member 24*d* having a cross-shaped cross-section (a cross-section with a stepped shape on the upstream side) as illustrated in FIG. 7D. Further, the columnar member may be a columnar member 24*e* having a flat plate-like cross-section facing the flow as illustrated in FIG. 7E. Further, the columnar member may be a columnar member 24*f* having a chevron cross-section with a slit in a central portion thereof as illustrated in FIG. 7F.

As illustrated in FIGS. 2, 5, 7A, 7B, 7C, and 7D, the columnar member preferably has a cross-sectional shape that is convex toward the upstream side of the flow of the cooling fluid in the horizontal plane. Since the cross-sectional shape of the columnar member in the horizontal plane is convex toward the upstream side of the flow of the cooling fluid, the jet of the cooling fluid from the inflow pipe can be effectively divided and dispersed in the horizontal direction. Further, the jet of the cooling fluid from the guide member is suppressed from hitting the columnar member hard and bouncing vertically upward. As a result, the effect of suppressing the turbulence of the liquid surface of the cooling fluid is improved.

Further, it is preferred that the columnar member has a rounded shape at a corner of a portion facing the flow of the cooling fluid (a shape in which a corner of an outer peripheral surface is rounded) as illustrated in FIGS. 7A and 7C. For example, it is preferred that the corner of the uppermost stream portion of the columnar member and/or both side end portions (an upper end portion and a lower end portion in FIGS. 7A to 7C) of the columnar member are rounded. If these portions are rounded, even when the jet of the cooling fluid hits the columnar member, and thus the flow of the cooling fluid is divided, generation of a vortex is suppressed around the columnar member. Therefore, it is possible to suppress the bubbles in the cooling fluid from being finely divided by the vortex and from being difficult to be separated.

Further, as illustrated in FIGS. 2, 5, 7A, 7C, and 7F, in the columnar member, it is preferred that the cross-sectional shape in the horizontal plane is formed such that the width of the columnar member at the upstream side of the flow of the cooling fluid toward the columnar member is smaller than that of the columnar member at the downstream side of the flow of the cooling fluid. Further, it is particularly preferred that the cross-sectional shape of the columnar member in the horizontal plane is such that the width of the columnar member increases toward the downstream side. When the columnar member has such a cross-sectional shape, the effect of division and dispersion of the cooling fluid by the columnar member is more remarkable. Therefore, the effect of suppressing the turbulence of the liquid surface of the cooling fluid is improved.

The columnar member may have a surface that faces substantially perpendicular to the jet of cooling fluid toward the columnar member, as illustrated in FIGS. 7C, 7D, and 7E. However, such a surface also causes the jet to bounce vertically upward and the liquid surface of the cooling fluid to undulate. Therefore, it is preferable to make the width of such a surface as narrow as possible.

Further, as illustrated in FIG. 7F, when the columnar member is the columnar member 24*f* having a slit in the central portion, the jet of the cooling fluid toward the columnar member can be divided and dispersed substantially in three directions by the columnar member 24*f*. Therefore, the effect of division and dispersion of the cooling fluid by the columnar member is more remarkable. Therefore, the effect of suppressing the turbulence of the liquid surface of the cooling fluid is improved. The size of the slit is adjusted so that the jet passing through the slit is appropriately weakened.

Figure 8:
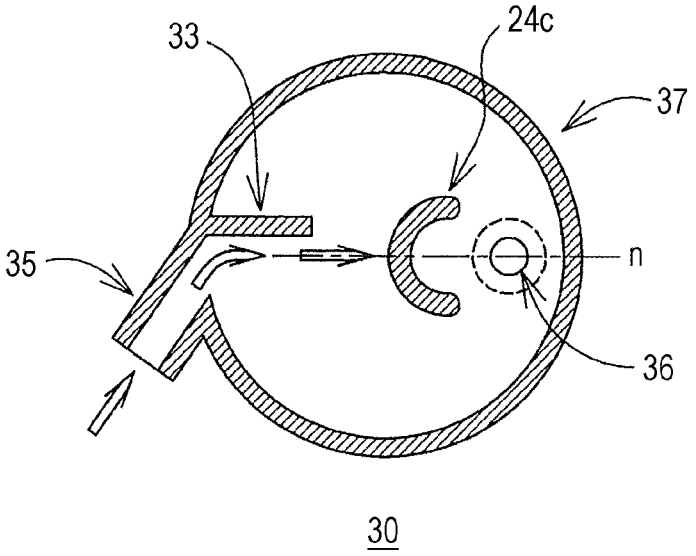
FIG. 8 is a horizontal cross-sectional view illustrating the structure of the reservoir tank of a third embodiment.

FIG. 8 illustrates a reservoir tank 30 of a third embodiment. FIG. 8 is a horizontal cross-sectional view of the reservoir tank 30 corresponding to FIG. 2 in the first embodiment. The reservoir tank 30 of the third embodiment is different from the reservoir tank 10 of the first embodiment, in the shape of the tank body 37, the shape of the guide member 33, and the shape and arrangement of the columnar member 24*c*. Other configurations of the reservoir tank 30 such as the position of the discharge pipe 36 are the same as those of the reservoir tank 10 of the first embodiment.

In the reservoir tank 10 of the first embodiment illustrated in FIG. 1, the shape of the tank body 17 is a rectangular parallelepiped shape. On the other hand, in the reservoir tank 30 of the third embodiment, the shape of the tank body 37 is spherical. The shape of the tank body 37 is not particularly limited, and may be another shape such as a cylindrical shape, an elliptical cylindrical shape, or an ellipsoidal shape.

Further, in the reservoir tank 30 of the third embodiment, the guide member 33 has a flat plate shape extending in the substantially vertical direction. As described above, the guide member may be a guide member having a non-curved guide surface. That is, the guide member 33 may be configured so that the jet of the cooling fluid flowing therein from an inflow pipe 35 flows in the substantially horizontal direction toward the columnar member.

Further, in the reservoir tank 30 of the third embodiment, the columnar member 24*c* has a C-shaped (arcuate) cross-section as illustrated in FIG. 7C. Then, the columnar member 24*c* is disposed so that the cross-section is convex toward the upstream side of the flow of the cooling fluid.

As in the reservoir tank 10 of the first embodiment illustrated in FIG. 1, also in the reservoir tank 30 of the third embodiment, the columnar member 24*c* extends in the substantially vertical direction when viewed along the flow of the cooling fluid toward the columnar member. As a result, a substantially horizontal flow from the guide member 33 hits the columnar member 24*c*, and the jet of the cooling fluid from the guide member 33 is divided and dispersed in the substantially horizontal direction. Therefore, a remarkable effect of suppressing the turbulence of the liquid surface of the cooling fluid can be obtained. Further, by providing the guide member 33, it is possible to obtain the effect of suppressing the turbulence of the liquid surface of the cooling fluid while increasing the degree of freedom in arranging the inflow pipe.

Further, in the reservoir tank described in the above-described embodiments, the columnar member extends in the substantially vertical direction when viewed from a direction perpendicular to both the extension line n of the flow toward the columnar member and the vertical direction (from a direction perpendicular to a paper surface of FIG. 1). However, the columnar member extending in the substantially vertical direction is not essential. The columnar member may be provided to be inclined with respect to the vertical direction when viewed from the direction perpendicular to both the extension line n of the flow of the cooling fluid toward the columnar member and the vertical direction. In this case, more specifically, it is preferred that the columnar member is provided to be inclined toward the upstream side of the flow of the cooling fluid as the columnar member goes upward in the vertical direction when viewed from the direction perpendicular to both the extension line n of the flow of the cooling fluid toward the columnar member and the vertical direction.

When the columnar member is inclined in this way, when the jet of the cooling fluid toward the columnar member hits the columnar member, the jet easily flows slightly downward in the vertical direction. Therefore, a more remarkable effect of suppressing the turbulence of the liquid surface of the cooling fluid can be obtained.

Figure 10:
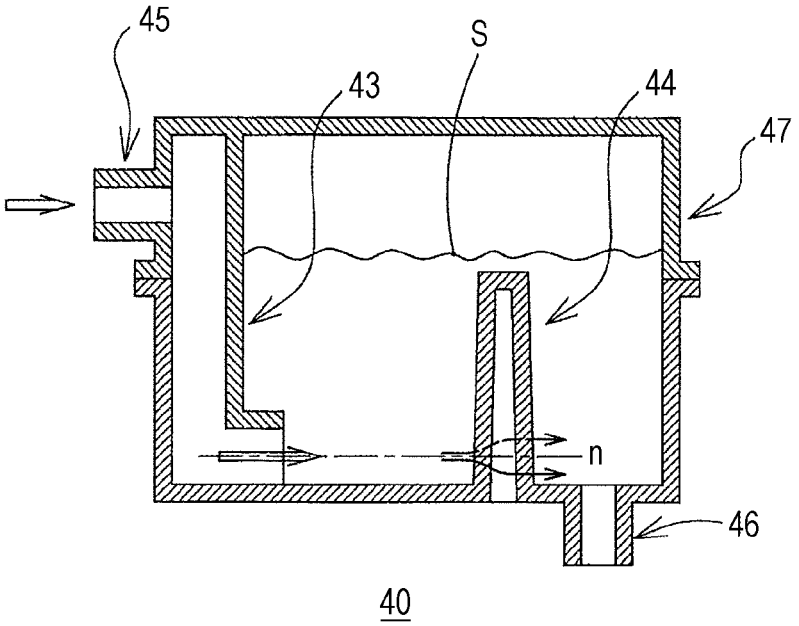
FIG. 10 is a vertical cross-sectional view illustrating the structure of the reservoir tank of a fourth embodiment.

FIG. 10 illustrates a reservoir tank 40 of the fourth embodiment. FIG. 10 is a vertical cross-sectional view corresponding to FIG. 1 in the first embodiment. In the reservoir tank 40 of the fourth embodiment, a shape of a guide member 43, a shape of a columnar member 44, and a position of an inflow pipe 45 are different from those of the reservoir tank 10 of the first embodiment. Other configurations such as a position of a discharge pipe 46 and a shape of a tank body 47 are the same as those of the reservoir tank 10 of the first embodiment.

In the reservoir tank 40 of the fourth embodiment, the guide member 43 is, for example, tubular. That is, a substantial pipe line is formed by the guide member 43 and a part of the wall surface of the tank body 47. This pipe line is connected to the inflow pipe 45 at one end thereof, and is opened to the inner space of the tank body 47 at the other end thereof. Then, the tubular guide member 43 guides the flow of the cooling fluid flowing from the inflow pipe 45 through the pipe line into the tank body in the substantially horizontal direction toward the columnar member 44. A part of the pipe line formed by the guide member 43 may extend in the substantially vertical direction.

The tubular guide member may be configured so that the jet of the cooling fluid flowing from the inflow pipe 45 is guided in the substantially horizontal direction toward the columnar member 44. For example, the guide member 43 may be configured such that the pipe line extends toward the columnar member 44 (in a direction of an axis n in FIG. 10) at the other end of the pipe line.

The other end side of the pipeline formed by the guide member 43 is opened to the inner space of the tank body at a position vertically below the liquid level S of the cooling fluid stored in the tank body. With such a configuration, the cooling fluid flows directly from the pipe line into the cooling fluid stored in the tank. Therefore, the effect of suppressing the turbulence of the liquid surface of the cooling fluid can be surely obtained.

According to the reservoir tank 40 of the fourth embodiment, the pipe line formed by the guide member 43 is connected to the inflow pipe 45 at one end thereof, and is opened in the tank body vertically below the liquid level S of the cooling fluid at the other end thereof. In this case, unlike the first to third embodiments, it is not essential that the inflow pipe 45 is connected to the tank body at a position vertically below the liquid level S of the cooling fluid stored in the tank body. In the fourth embodiment, the pipe line formed by the guide member 43 functions as an extension pipe of the inflow pipe 45. Therefore, substantially the same effect as when the inflow pipe is connected to the tank body at a position below the liquid level S of the cooling fluid can be obtained.

Similar to the reservoir tank 10 of the first embodiment illustrated in FIG. 1, also in the reservoir tank 40 of the fourth embodiment, the columnar member 44 extends in the substantially vertical direction when viewed along the flow of the cooling fluid toward the columnar member (in the direction of the axis n in FIG. 10). As a result, the substantially horizontal flow from the guide member 43 hits the columnar member 44, and the jet of the cooling fluid from the pipe line is divided and dispersed in the substantially horizontal direction. As a result, the remarkable effect of suppressing the turbulence of the liquid surface of the cooling fluid can be obtained. Further, by providing the guide member 43, it is possible to obtain the effect of suppressing the turbulence of the liquid surface of the cooling fluid while particularly increasing the degree of freedom in arranging the inflow pipe. That is, according to the reservoir tank 40 of the fourth embodiment, the inflow pipe 45 may be connected at a position vertically higher than the liquid level S of the cooling fluid. Therefore, the degree of freedom in layout is particularly increased.

The reservoir tank according to the embodiment of the present disclosure may have other structures. For example, the reservoir tank may be provided with a removable cap. Through such a cap, the cooling fluid can be filled in the tank or the cooling fluid circuit. Further, the cap may be provided with a pressure release valve. Further, a stay or a boss member for attaching the reservoir tank to a vehicle body or the like may be integrated with the reservoir tank as necessary. Furthermore, the reservoir tank may be provided with a reinforcing structure such as a rib depending on a pressure resistance required for the reservoir tank.

The reservoir tank according to the embodiments of the present disclosure may be the following first to eighth reservoir tanks.

The first reservoir tank is a reservoir tank provided in the cooling fluid circuit of the liquid-cooled cooling system, and includes the tank body that stores the cooling fluid, the inflow pipe for feeding the cooling fluid to the tank body, and the discharge pipe that discharges the cooling fluid from the tank body, in which the inflow pipe is connected to the tank body at a position vertically below the liquid level of the cooling fluid stored inside the tank body, the columnar member is erected inside the tank body, the guide member is provided inside the tank body, the guide member guides the flow of the cooling fluid flowing from the inflow pipe into the tank body, the flow being guided into the substantially horizontal direction toward the columnar member, the columnar member extends in the substantially vertical direction when viewed along the flow of the cooling fluid toward the columnar member, and a part of the columnar member is disposed on the extension line of the flow of the cooling fluid toward the columnar member.

The second reservoir tank is the first reservoir tank, in which a plurality of columnar members is arranged such that the flow of the cooling fluid from the guide member to the columnar member is divided in the substantially horizontal direction by the first columnar member, and the divided flow is further divided in the substantially horizontal direction by the second columnar member.

The third reservoir tank is the first reservoir tank, in which the position in which the extension line of the flow of the cooling fluid toward the columnar member and the columnar member intersect is vertically below the liquid level of the cooling fluid.

The fourth reservoir tank is the first reservoir tank, in which the guide member has a curved guide surface, and the central axis of the inflow pipe forms an angle of 30 degrees or more and 90 degrees or less with respect to the horizontal plane.

The fifth reservoir tank is any one of the first to fourth reservoir tanks, in which the columnar member is disposed to connect the top surface and the bottom surface of the tank body.

The sixth reservoir tank is any one of the first to fourth reservoir tanks, in which the cross-sectional shape of the columnar member in the horizontal plane is convex toward the upstream side of the flow of the cooling fluid.

The seventh reservoir tank is any one of the first to fourth reservoir tanks, in which the width of the columnar member when viewed along the flow of the cooling fluid toward the columnar member is 0.5 times or more and 3 times or less the diameter of the inflow pipe.

The eighth reservoir tank is a reservoir tank provided in the cooling fluid circuit of the liquid-cooled cooling system, and includes the tank body that stores the cooling fluid, the inflow pipe for feeding the cooling fluid to the tank body, and the discharge pipe that discharges the cooling fluid from the tank body, in which the columnar member is erected inside the tank body, the guide member is provided inside the tank body, the guide member is formed in a tubular shape and is connected to the inflow pipe at one end of the guide member, and guides the flow of the cooling fluid flowing from the inflow pipe into the tank body to the flow flowing in the substantially horizontal direction toward the columnar member, the other end of the guide member is opened to the inner space of the tank body at a position vertically below the liquid level of the cooling fluid stored inside the tank body, the columnar member extends in the substantially vertical direction when viewed along the flow of the cooling fluid toward the columnar member, and a part of the columnar member is disposed on the extension line of the flow of the cooling fluid toward the columnar member.

The reservoir tank according to the embodiments of the present disclosure can be used in the cooling fluid circuit of the cooling system. The reservoir tank according to the embodiment of the present disclosure has high industrial utility value because it can suppress the generation of the bubbles in the cooling fluid.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A reservoir tank comprising:

a tank body that stores cooling fluid;

an inflow pipe configured to feed the cooling fluid into the tank body;

a discharge pipe configured to discharge the cooling fluid from the tank body;

a columnar member erected inside the tank body; and a guide member provided inside the tank body, wherein the inflow pipe is connected to the tank body at a position vertically below a liquid level of the cooling fluid stored inside the tank body, the guide member is configured to guide a flow of the cooling fluid flowing from the inflow pipe into the tank body, the flow being guided into a substantially horizontal direction toward the columnar member, the columnar member extends in a substantially vertical direction when viewed along the flow of the cooling fluid toward the columnar member, a part of the columnar member is disposed on an extension line of the flow of the cooling fluid toward the columnar member, and a cross-sectional shape of the columnar member in a horizontal plane is convex toward an upstream side of a flow of the cooling fluid.

2. The reservoir tank according to claim 1, comprising a plurality of the columnar members including a first columnar member and a second columnar member, wherein the plurality of columnar members is arranged so that a flow of the cooling fluid flowing from the guide member toward the columnar members is divided in a substantially horizontal direction by the first columnar member, and the divided flow of the cooling fluid is further divided in the substantially horizontal direction by the second columnar member.

3. The reservoir tank according to claim 1, wherein a position in which the extension line of the flow of the cooling fluid toward the columnar member and the columnar member intersect is vertically below the liquid level of the cooling fluid.

4. The reservoir tank according to claim 1, wherein the guide member has a curved guide surface, and a central axis of the inflow pipe forms an angle of 30 degrees or more and 90 degrees or less with respect to a horizontal plane.

5. The reservoir tank according to claim 1, wherein the columnar member is disposed to connect a top wall and a bottom wall of the tank body.

6. The reservoir tank according to claim 1, wherein a width of the columnar member when viewed along the flow of the cooling fluid toward the columnar member is 0.5 times or more and 3 times or less a diameter of the inflow pipe.

* * * * *